US005225058A

United States Patent [19]

Bazzoni et al.

[11] Patent Number: 5,225,058

[45] Date of Patent: Jul. 6, 1993

[54] CONTROL AND AUTOMATIC REGULATION DEVICE FOR CATHODIC PROTECTION SYSTEMS IN REINFORCED CONCRETE STRUCTURES

[75] Inventors: Bruno Bazzoni; Luciano Lazzari, both of Milan, Italy

[73] Assignee: Nuova Polmet Cathodic Protection S.R.L., Italy

[21] Appl. No.: 659,269

[22] Filed: Feb. 22, 1991

[30] Foreign Application Priority Data

Feb. 26, 1990 [IT] Italy ..... 19484 A/90

[51] Int. Cl.[5] ..... C23F 13/00

[52] U.S. Cl. ..... 204/196; 204/147; 204/290 F

[58] Field of Search ..... 204/147, 148, 196, 197

[56] References Cited

U.S. PATENT DOCUMENTS

| | | | |
|---|---|---|---|
| 3,142,631 | 7/1964 | Woodley | 204/196 |
| 3,208,925 | 9/1965 | Hutchison et al. | 204/196 |
| 3,714,004 | 1/1973 | Riggs et al. | 204/196 |
| 4,255,241 | 3/1981 | Kroon et al. | 204/196 |
| 4,592,818 | 6/1986 | Cavil et al. | 204/196 |
| 4,855,024 | 8/1989 | Drachnik et al. | 204/147 |

OTHER PUBLICATIONS

"Cathodic Protection of Carbon Steel in Phosphoric Acid," Olen L. Riggs, Jr. Materials Protection and Performance, pp. 21-26, vol. 9, No. 10, Oct. 1970.

*Primary Examiner*—T. Tung

*Attorney, Agent, or Firm*—Nixon & Vanderhye

[57] ABSTRACT

Device for the control and regulation of the feeding unit (60), as well as for monitoring of impressed current cathodic protection systems in reinforced concrete in order to avoid any risks of reinforcement (10) over-protection and to prevent hydrogen embrittlement problems, while assuring full protection of reinforcements.

24 Claims, 3 Drawing Sheets

CONTROL AND AUTOMATIC REGULATION DEVICE FOR CATHODIC PROTECTION SYSTEMS IN REINFORCED CONCRETE STRUCTURES

BACKGROUND

1. Field of the Invention

The present invention finds its application in the field of impressed current cathodic protection of reinforced concrete structures.

2. Prior Art and Other Conciderations

Cathodic protection of reinforced concrete is used to prevent or to stop corrosion of metallic reinforcements.

The most typical application field is in bridges, slabs, beams, piers, multi-story parkings, garages, etc-,—situated in cold regions, where corrosion is caused by de-icing salts, as well as in structures exposed to marine environment.

This kind of systems is realized either using an anode structure typically having a net arrangement (i.e. titanium activated by noble metal oxides) or applying conductive coatings.

The main characteristic of any cathodic protection system in reinforced concrete structures is to guarantee that the protection conditions be extended to the whole surface of reinforcements, without reaching over-protection conditions.

The former condition obviously applies to any kind of structures; the latter, though being important in the protection of standard reinforced concrete structures, becomes mandatory where pre-stressed or post-tensioned concrete elements are present and have to be protected. In fact, steels used for this type of structures exhibit very high mechanical characteristics, generally not lower than 1400 MPa, making them extremely exposed to the risk of hydrogen embrittlement phenomena.

This means that, in a cathodic protection system applied to a pre-stressed or post-tensioned reinforced concrete structure, if the potential of these steels gets below the threshold value, in correspondence of which the hydrogen evolution reaction becomes appreciable, hydrogen embrittlement may occur.

For the steels generally used in these structures, this threshold value ranges around −0.9 V with respect to Ag/AgCl electrode (W. H. Hartt, P. K. Narayanan, T. Y. Chen, C. C. Kumira, "Cathodic Protection and Environmental Cracking of Prestressing Steel", CORROSION/89, paper n. 382, NACE, New Orleans, April 1989; R. N. Parkins et al., "Environmental Sensitive Cracking of Prestressing Steels", Corrosion Science 22, p. 379, 1982).

When using carbon or low alloy steels showing ordinary mechanical characteristics, no embrittlement is observed. A threshold value is however set around—1.1 V (The Concrete Society Tech. Report N, 36 "Cathodic Protection of Reinforced Concrete", London 1988). In fact, beyond this potential value, it is not advisable to operate, not only due to economic reasons, but also to avoid possible occurrence of reduced bond between concrete and reinforcement.

Traditional monitoring technique for cathodic protection is based on the following check operations:

1. protection conditions are reached (i.e. by means of the so-called 100 mV decay method, that consists in checking that the cathodic potential variation, in the first four hours after opening the circuit, exceeds 100 mV) and, 2. potential of reinforcements is always nobler than the above mentioned critical value, (i.e. 100 mV) so as to exclude any over-protection risks.

That criteria are not suitable for pre-stressed concrete and, in any case, also for ordinary concrete, cannot avoid overprotection condition in some points (for instance, where rebars are very close to the anode, in correspondence of zone of concrete where the resistivity becomes unexpectedly very low due to chloride contamination). In fact, the detection of possible over-protection conditions is strongly dependent on the location of reference electrodes (portable or fixed); it follows that only monitored zones (i.e. presence of reference eletrode) are controlled, that means a few percent of the protected area, and are not representative of the map of the potentials on the whole surface of reinforcements. In effect, the potential of the surface of reinforcements is not uniform, but varies from one to another point, depending on the position with respect to the anode surface and to surrounding reinforcements. The amount of the variations changes with operating and environmental conditions. For instance, during winter or in high atmospheric humidity conditions, for which the oxygen diffusion within concrete may be difficult, such local variations may be very high.

DESCRIPTION OF THE INVENTION

The present invention consists in a device able to check that protection conditions are reached (i.e. using the well-known 100 mV decay method) and to ensure that no over-protection conditions are achieved.

The innovative idea has its base on the measurement of the potential of the anode, instead of the measurement of the potential of the protected structure (i.e. reinforcements) as it has been done up to now for the concrete cathodic protection applications.

Moreover the present invention is based on some peculiar features regarding voltages involved in cathodic protection systems for concrete.

The feeding voltage, E, can be considered as the sum of: anode voltage, Ea, cathodic voltage Ec, ohmic drops in metallic conductors, Em, and ohmic drops in concrete, Eohm:

$$E = Ea - Ec + Eohm + Em \quad (1)$$

As far as Ec is concerned, it should be ranged within an interval limited, on its lower side, by the above mentioned minimum value, that is in case of high strength steels, for pre-stressed or post-stressed reinforced concrete −0.90 V, whereas for standard steels used in reinforced concrete −1.1 V (all potential values are referred to Ag/AgCl electrode).

As far as Ea is concerned, it slowly rises in time, at least in the first years operation. In case of activated titanium, it passes, from an initial value of about 0.4 V to 0.7–0.9 V, or higher, a few years after (P. Pedeferri et al. "Cathodic protection of Steel in Concrete with Expanded Titanium Anode Net System", UK Corrosion Conference, Blackpool, England, 8–10 November). It can also vary with environmental conditions, particularly with temperature and therefore with seasons. However, unlike cathodic potential, Ea is generally uniform on all the anode surface. This uniformity depends on the use of the special distributors that reduce attenuation as well as on the particular electrocatalytic characteristics of the materials used.

The ohmic drop Eohm has very low values, because of the low currents involved, except for in particularly dry concrete. It is mainly localized in close proximity of the anode, where current density is greater. The term of any ohmic drop different from the ohmic drop in proximity of the anode can therefore be disregarded (and this makes the whole system more conservative). The ohmic contribution localized on the anode is determined along with the anode potential by means of reference electrode placed between anode and cathode (i.e. the same electrode used to check that protection conditions are reached by means of 100 mV decay method can be utilized). Actually, the meaning of anode potential here considered, Ea,on results to be equal to Ea true+Eohm (see equation 1).

The term Em ohmic drop in metallic conductors, includes ohmic drops in the anodic feeding cables (ohmic drops in the rebars are negligible) and ohmic drops in anodic structures, i.e. the net and the relevant distribution strips. It depends on the flowing current.

Therefore equation (1) can be rewritten as follows:

$$E = Ea,on - Ec + Em \quad (2)$$

The present invention consists in a device for the control and regulation of the feeding unit in cathodic protection systems for reinforced concrete, that is based on the measurement of the feed voltage and of the anode potential instead of the cathodic potential, as it happens in traditional cathodic protection systems.

This device is able to guarantee safe protection conditions of reinforcements, as far as overprotection is concerned.

This device, in its preferred embodiment, consists of a control unit where the following parameters are set: minimum protection potential (−0.90 or −1.1 V); initial voltage or current, Eo or Io; this control unit periodically determines: feed voltage, E, and anode potential Ea,on; the current involved and the ohmic drop contribution in metallic conductors, Em; moreover, it performs routine protection tests based, for instance, on 100 mV decay method.

The control unit can be applied to systems operating both at "imposed voltage" (called "constant voltage") and at "imposed current" (called "constant current").

If the system operates at "constant voltage", the control unit imposes the pre-established initial voltage, checks, based on one or more measurements of the cathodic potential and following traditional principle, that protection conditions of reinforcements be reached (i.e. using the well-known 100 mV decay criteria) and, if such conditions would not be reached, it adjusts the feed voltage in order to meet this requirement; then, it measures the anode potential, Ea,on, then it calculates the cathodic potential Ec in order to check that no overprotection conditions are achieved.

In case of pre-stressed concrete structures, it checks that the following inequality is verified:

$$Ec = -E + Ea,\ on + Em > -0.90\ V \quad (3)$$

In case of standard reinforced concrete structures:

$$Ec = -E + Ea,\ on + Em > -1.1\ V \quad (4)$$

The measurement of the anode potential Ea is therefore periodically performed, for example a few times every day, always re-calculating the operating voltage of the feeder.

A more accurate control can be realized if the anodic potential is taken as close as possible to the electrical connection of the power cables to the anodic structure, by means of an auxiliary, current free, electrical cable. In this case, in fact, the contribution of the ohmic drop in the cables is eliminated.

In case of feeding "at constant current", the control unit imposes a pre-established initial current and checks that protection conditions be reached without the occurrence of overprotection conditions. This latter control is carried out by means of a measurement of the feed voltage and the anode potential and of the calculation of the cathodic potential as per equation (2), that should be greater than the above-cited threshold values. If this threshold value exceeds the cathodic potential, the control unit reduces the feed current so as to exclude overprotection conditions.

In a simplified version of the device, the feeding unit imposes a constant voltage, E, calculated as the sum of the measured anode potential Ea,on of the cathodic potential Ec and of the ohmic contributions, Em, where Ec and Em contributions are pre-determined; the control and automatic regulation are performed by periodically measuring the potential of the anode structure Ea,on, and then re-calculating the new feed voltage, so as to keep the structure constantly under protection conditions, avoiding any overprotection risks.

The anode potential Ea,on can be measured using several reference electrodes which are representative of zones with different concrete conductivity, when using such several electrodes, the control device should be able to properly process signals so as to obtain one value (i.e. the lowest value) to be entered in the sum for E calculation.

As above discussed, the principle of the system relies mainly on the higher uniformity of the potential of the anodic structure, compared with the cathode.

On this regard, possible reasons for a non uniform potential of the anode are:

a. - ohmic drops (or attenuation) in the metallic conductors (anode net included)

b. - non uniform current requirements on the structures

As far as the first point is concerned, the right answer comes from a correct design of the anodic structure in terms of maximum allowed attenuation: for instance net and distributors can be designed in order to keep the ohmic drops below 100 mV. Furthermore, reference electrode for reading of Ea,on can be located close to the connection between power cable and anodic structure, where potential losses due to ohmic drops are expected to be minimal (and current density to be higher).

With reference to the second aspect, that is nonuniform current distribution all over the structure, it is often difficult to predict areas of higher current density. However relevant mistakes are limited because of the specific electrochemical behaviour of the anodic material has considered. In fact, as it results from readings taken on a real structure under protection, when the current density increases from 10 to 20 ma/m$^2$ (concrete surface), the anodic potential goes from +0.47 V vs Ag/AgCl to +530, which means a potential disuniformity lower than 60 mV.

As a protection against possible failures that might take place in the circuits or in reference electrodes, the device is provided with a safety system which, when the feed voltage should reach a given Emax value, automatically brings the voltage back to a lower value Emin (i.e. 1.5 V), pre-established as well, simultaneously activating an alarm signal. In this way, the cathodic protection system could operate in under protection conditions, but it would never find in the much more dangerous over-protection conditions.

Furthermore, in case the control device couldn't regulate the power unit, another protection can be foreseen which automatically switch off the transformer rectifier.

The device is realized as an "intelligent" system, such as for instance a microprocessor or a personal computer, equipped with an adequate number of analogical inputs and outputs, able to run a program for the management of the system and of variables: input data acquisition, measurement of the anode potential, calculation of the feed voltage etc: The system is then connected to the feeding unit, to which it transmits the order for the adjustment of the voltage or feeding current, and if necessary, to a data acquisition unit for storing all systems current data or to a data transmission unit.

EXAMPLE 1

A system for cathodic protection of a pre-stressed concrete bridge deck consists of several units, each one with its own transformer-rectifier feeding a mixed metal oxide activated titanium net, having a rectangular surface of 360 $m^2$.

Connections between power cables and anodic structure are located at one side of the net.

A reference electrode has been placed in correspondance of the power connection side, positioned close to the titanium net. A second reference electrode of the same type has been placed at the opposite side, close to the rebar.

The anodic structure has been designed to have a maximum ohmic drop in metallic conductors lower than 100 mV at the maximum design current density, equal to 20 $mA/m^2$ referred to the concrete surface.

Free corrosion potential of rebar, measured by means of fixed reference electrodes as well as by portable ones, ranges between −0.1 and −0.25 V vs Ag/AgCl, while the potential of the anodic structures in same conditions is equal to −0.18 V.

Power unit is a "constant voltage" type and it is controlled by an automatic regulation device which operates as follows. The control unit informs the power unit to start with an initial voltage E0 equal to 1.0 V, calculated by the operator assuming Ec=−0.5 V, Ea,on=0.45 V and Em=0.05 V. Current output is equal to 3.2 A, corresponding to a current density of 9 $mA/m^2$. The control unit checks that protection conditions are reached, in accordance with the 100 mV decay criteria, and it takes the reading of Ea,on. Then it verifies that the following inequality is verified:

$$Ec=-Eo+Ea,on+Em>-0.90\ V$$

where −0.90 V represents the more negative allowed potential for the cathode, i.e. the rebar.

At start up, with 1.0 V applied, protection conditions are satisfied (about 150 mV of polarization are measured in the off status), and the measured potential of the anode, Ea,on, is equal to +0.43 V. From these figures, assuming as stated above 50 mV as maximum allowed contribution for ohmic drops, the calculated value for Ec is equal to −0.52 V, more positive than the minimum allowed.

After almost two years the anodic potential increased to +0.75 V and in the mean time polarization of the rebar falls below 100 mV. In accordance to these data, the control unit automatically increased the applied potential from 1.0 to 1.2 V, step by step, recalculating the cathode potential, Ec, equal to −0.45 V, and verifying the compliance with above written inequality, which again is verified.

If this would not be achieved, the device reduces the applied voltage and repeats control operations.

FIG. 1 reports the flux diagram of the operation carried out by the control unit.

EXAMPLE 2

Reinforced concrete slab protected using a "constant current" feeding system. No high strength steel is present. The system imposes an initial current density of 10 $mA/m^2$ (based on experience, the initial current required is ranged between 10 and 20 $mA/m^2$) and calculates circulating current and ohmic drops in wires. The system adjusts current so that the protection conditions are reached, based in 100 mV decay method; in the negative, it adjusts current until reaching protection conditions.

At the same time, it measures E0 and Ea, on and verified the inequality $$Ec=-Eo,+Ea,on+Em>-1.1\ V$$

If this would not be achieved, it reduces current by 20% and repeats the control.

FIG. 2 reports the diagram of the device.

FIG. 3 is a plan view of a cathodically protected bridge slab, showing the anode net structure; FIG. 4 is a sectional view along the line IV—IV of FIG. 3.

Figure 1:
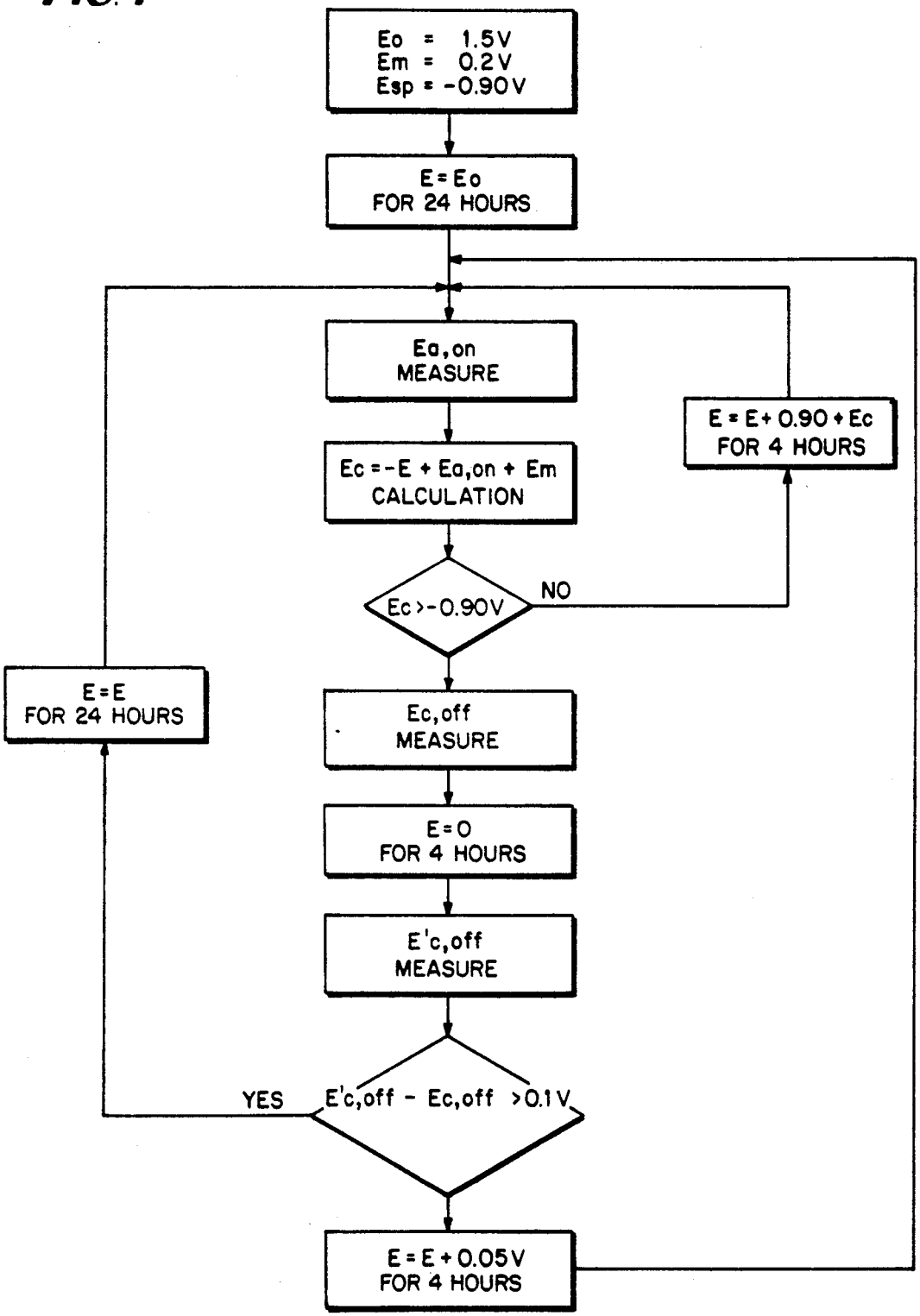
Figure 2:
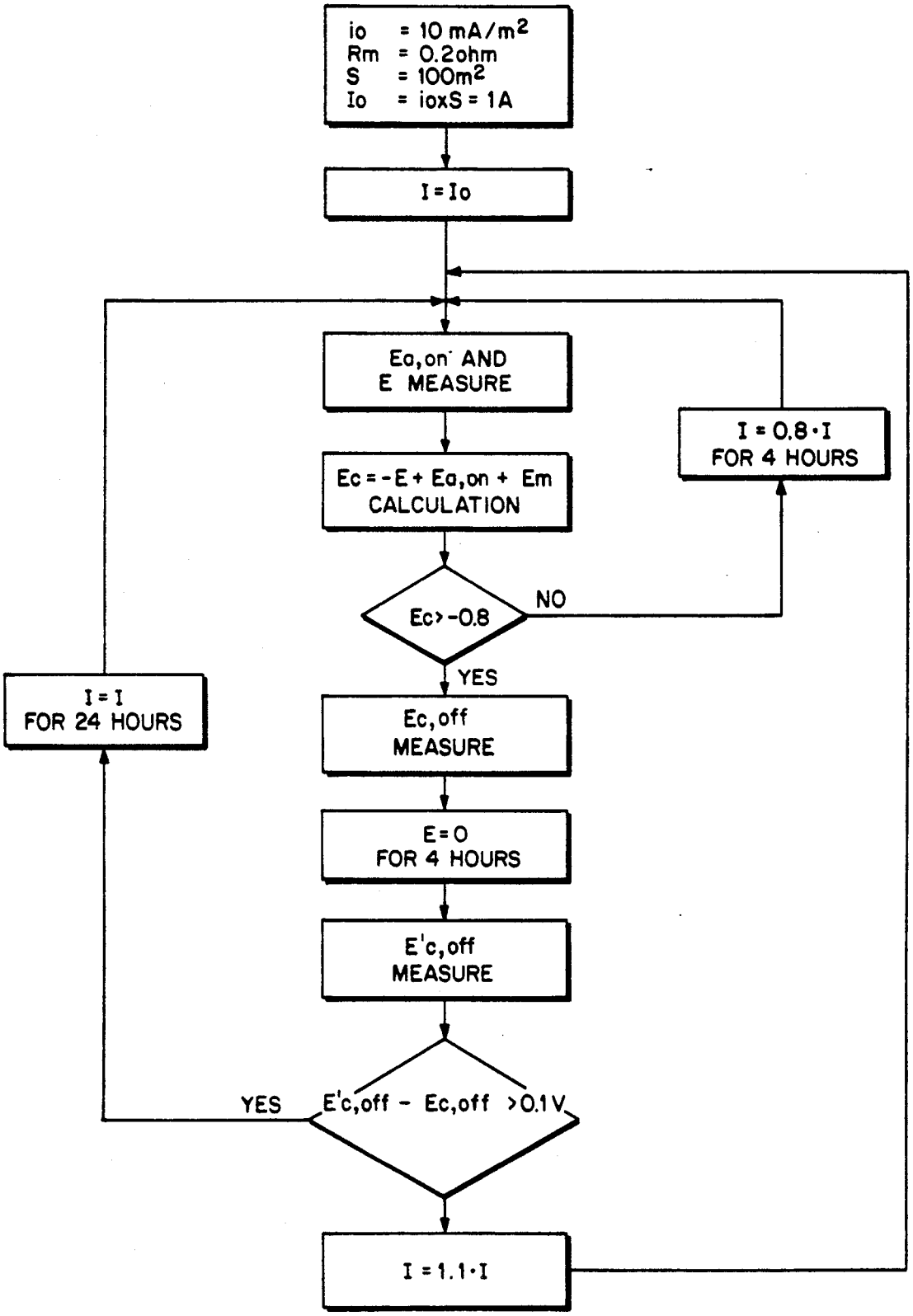
Figure 3:
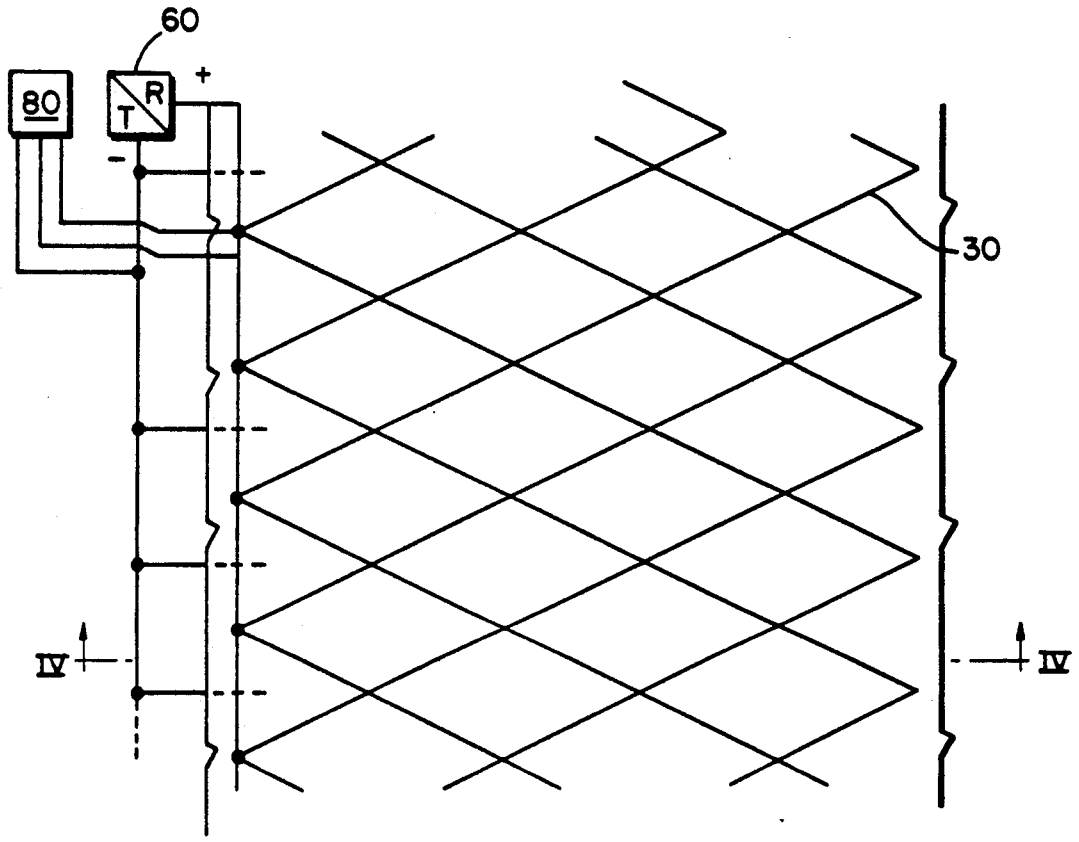
FIGS. 3 and 4 illustrate the main elements of a cathodic protection system for reinforced concrete structure, following the present invention.
Figure 4:
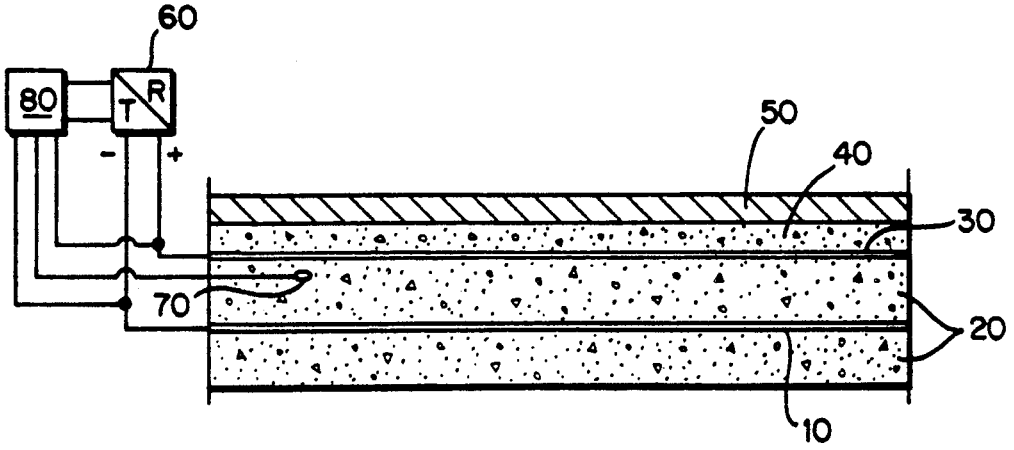

The slab consists in a metallic reinforcement 10, behaving as cathode, buried in concrete 20, above which an anode net structure is laid. The anode net 30 is covered by a layer of cement 40, over which the asphalt 50 is then laid.

The necessary potential difference between anode and cathode 10 is maintained by means of a feeder 60 able to operate at both constant voltage and constant current.

Between anode 30 and cathode 10, at least one reference electrode 70 is installed, connected to a control unit 80, that intervenes on the feeder 60 for necessary adjustments, in order to keep the system in proper protection conditions, avoiding any overprotection risks.

We claim:

1. A cathodic protection system comprising:

a metallic reinforcement member embedded in concrete;

an anode structure overlaying the concrete in which the metallic reinforcement member is embedded;

a reference electrode embedded in the concrete between the metallic reinforcement member and the anodic structure;

power supply means connected to the anode structure by anodic feeding cables and to the metallic reinforcement member for supplying a voltage, whereby the metallic reinforcement member behaves as a cathode;

control means connected to the power supply unit to receive a signal having a value E, the control means also being connected to the reference electrode to receive a signal having a value Ea,on, the control means further being connected to the power supply unit for adjusting the voltage supplied thereby whereby $$-E+Ea,on+E$$

is greater than a predetermined minimum protection potential, and wherein E is a value indicative of the voltage of the power supply unit; Ea,on is a value indicative of a potential between the anode structure and the reference electrode; and, Em is a value indicative of ohmic drops in the anodic structure and the anodic feeding cables.

2. The apparatus of claim 1, wherein the power supply unit operates at a constant voltage.

3. The apparatus of claim 1, wherein the power supply unit operates at a constant current.

4. The apparatus of claim 1, wherein the predetermined minimum protection potential is −0.90 volts with respect to a Ag/AgCl electrode for pre-stressed concrete.

5. The apparatus of claim 1, wherein the predetermined minimum protection potential is −1.1 volts with respect to a Ag/AgCl electrode for reinforced concrete.

6. The apparatus of claim 1, further having a plurality of reference electrodes embedded in the concrete structure, and wherein the control means is connected to the plurality of reference electrodes to receive a plurality of signals from which the control means determines the value Ea,on.

7. The apparatus of claim 6, wherein the control means determines the value Ea,on by determining the mean value of the signals received from the plurality of reference electrodes.

8. The apparatus of claim 6, wherein the control means determines the value Ea,on by determining the root-mean-square of the signals received from the plurality of reference electrodes.

9. The apparatus of claim 1, wherein the control means comprises data processing means.

10. The apparatus of claim 1, further comprising memory means connected to the control means.

11. The apparatus of claim 1, further comprising alarm means connected to the control means, and wherein the control means activates the alarm means when the supplied voltage exceeds a predetermined voltage.

12. The apparatus of claim 1, wherein the anode structure is covered by cement.

13. A cathodic protection system comprising:

a metallic reinforcement member embedded in concrete;

an anode net structure overlaying the concrete in which the metallic reinforcement member is embedded;

a reference electrode embedded in the concrete between the metallic reinforcement member and the anodic structure;

power supply means connected to the anode structure by anodic feeding cables and to the metallic reinforcement member for supplying a voltage, whereby the metallic reinforcment member behaves as a cathode;

control means connected to the power supply unit to receive a signal having a value E, the control means also being connected to the reference electrode to receive a signal having a value Ea,on, the control means further being connected to the power supply unit for adjusting the voltage supplied thereby whereby $$-E+Ea,on+Em$$

is greater than a predetermined minimum protection potential, and wherein E is a value indicative of the voltage of the power supply unit; Ea,on is a value indicative of a generally uniform potential between the anode net structure and the reference electrode; and, Em is a value indicative of ohmic drops in the anodic structure and the anodic feeding cables.

14. The apparatus of claim 13, wherein the power supply unit operates at a constant voltage.

15. The apparatus of claim 13, wherein the power supply unit operates at a constant current.

16. The apparatus of claim 13, wherein the predetermined minimum protection potential is −0.90 volts with respect to a Ag/AgCl electrode for pre-stressed concrete.

17. The apparatus of claim 13, wherein the predetermined minimum protection potential is −1.1 volts with respect to a Ag/AgCl electrode for reinforced concrete.

18. The apparatus of claim 13, further having a plurality of reference electrodes embedded in the concrete structure, and wherein the control means is connected to the plurality of reference electrodes to receive a plurality of signals from which the control means determines the value Ea,on.

19. The apparatus of claim 18, wherein the control means determines the value Ea,on by determining the means value of the signals received from the plurality of reference electrodes.

20. The apparatus of claim 18, wherein the control means determines the value Ea,on by determining the root-mean-square of the signals received from the plurality of reference electrodes.

21. The apparatus of claim 13, wherein the control means comprises data processing means.

22. The apparatus of claim 13, further comprising memory means connected to the control means.

23. The apparatus of claim 13, further comprising alarm means connected to the control means, and wherein the control means activates the alarm means when the supplied voltage exceeds a predetermined voltage.

24. The apparatus of claim 13, wherein the anode net structure is covered by cement.

* * * * *